United States Patent [19]

Casteel

[11] Patent Number: 4,955,181

[45] Date of Patent: Sep. 11, 1990

[54] WIPE DOWN APPARATUS FOR STRETCH WRAPPING DEVICES

[75] Inventor: Larry Casteel, Homerville, Ohio

[73] Assignee: Liberty Industries, Girard, Ohio

[21] Appl. No.: 427,502

[22] Filed: Oct. 27, 1989

[51] Int. Cl.[5] ..... B65B 11/04

[52] U.S. Cl. ..... 53/556; 53/587

[58] Field of Search ..... 53/556, 587, 588, 441; 15/119 R, 228, 230.14, 230.16

[56] References Cited

U.S. PATENT DOCUMENTS

| | | | |
|---|---|---|---|
| 2,023,021 | 12/1935 | Jenkins . | |
| 3,808,739 | 3/1974 | Newgent . | |
| 4,083,163 | 4/1978 | Ganz | 53/210 |
| 4,232,501 | 11/1980 | Stackhouse | 53/587 X |
| 4,524,568 | 6/1985 | Lancaster et al. | 53/556 |
| 4,563,863 | 1/1989 | Humphrey | 53/587 |
| 4,735,033 | 4/1988 | Stackhouse | 53/587 |
| 4,779,396 | 8/1988 | Stackhouse | 53/587 |

*Primary Examiner*—John Sipos

*Attorney, Agent, or Firm*—Harpman & Harpman

[57] ABSTRACT

A wipe down apparatus for use on web wrapping devices used to unitize a multiple unit wrapped load. The wipe down apparatus includes an extensible wiper support and a wiper element having one or more strips, one of which is double back along a portion of its length to form a load engaging loop. The strips being flexible along focal points when in contact with a load and moving parallel with the load wiping the wrapped load as it passes the wiper support.

7 Claims, 2 Drawing Sheets

WIPE DOWN APPARATUS FOR STRETCH WRAPPING DEVICES

BACKGROUND OF THE INVENTION

1. Technical Field

This invention relates to wipe down devices used to engage a utilized web wrapped load and to wipe down the web. The web wrapped load is common in the use of stretch wrapping machines that envelope a predetermined load with a plurality of overlapping film webs and are generally known in the art. The end of the film web is wiped down after cutting to secure same to the wrap load which requires a flexible element that will adapt to the contours of the load which may vary from load to load.

2. Description of Prior Art

Prior Art devices of this type have relied on a variety of different wipe down engagement elements and associated support and control structures, all in attempt to achieve an efficient and durable wipe down device.

Examples of such are U.S. Pat. Nos. 4,779,396, 4,735,033, 4,563,863.

In U.S. Pat. No. 4,779,396 a wipe down arrangement for a wrapping apparatus disclosed that uses a plurality of vertically aligned wipers with each wiper comprising at least one strip of a length greater than its width having oppositely disposed ends, one of which is secured to a wiper support while the free end is engageable against a load.

U.S. Pat. No. 4,735,033 discloses a wipe down device that utilizes a plurality of vertically aligned wipers with each wiper comprised on one strip doubled back along its length to form an elongated loop. Both ends of the strip are secured to a common wiper support element that can be pivoted on a predetermined arc to engage the loop on the load to wipe down same.

In U.S. Pat. No. 4,563,863 a device is directed towards an automatic stretch wrapping machine that uses a multiple filamented wipe down element. A support arm and activation arm advance the wipe down element against the load.

A number of other prior art devices are noted that utilize flexible loop configurations used in different art areas, such as U.S. Pat. No. 3,808,739 for a golf course water collector and U.S. Pat. No. 4,083,163 on a package forming machine and U.S. Pat. No. 2,023,021 on a self-wringing mop.

SUMMARY OF THE INVENTION

A wipe down device to engage unitized web wrapped loads common to stretch wrap machines comprises an extensible wiper support having at least one wiper element thereon. The wiper element forming a load engaging loop on its free end and force enhancing deflectible strips inwardly of its loop to wipe down the web wrapped unitized load by relative movement between the wiper support and the load.

DESCRIPTION OF THE PREFERRED EMBODIMENT

Figure 1:
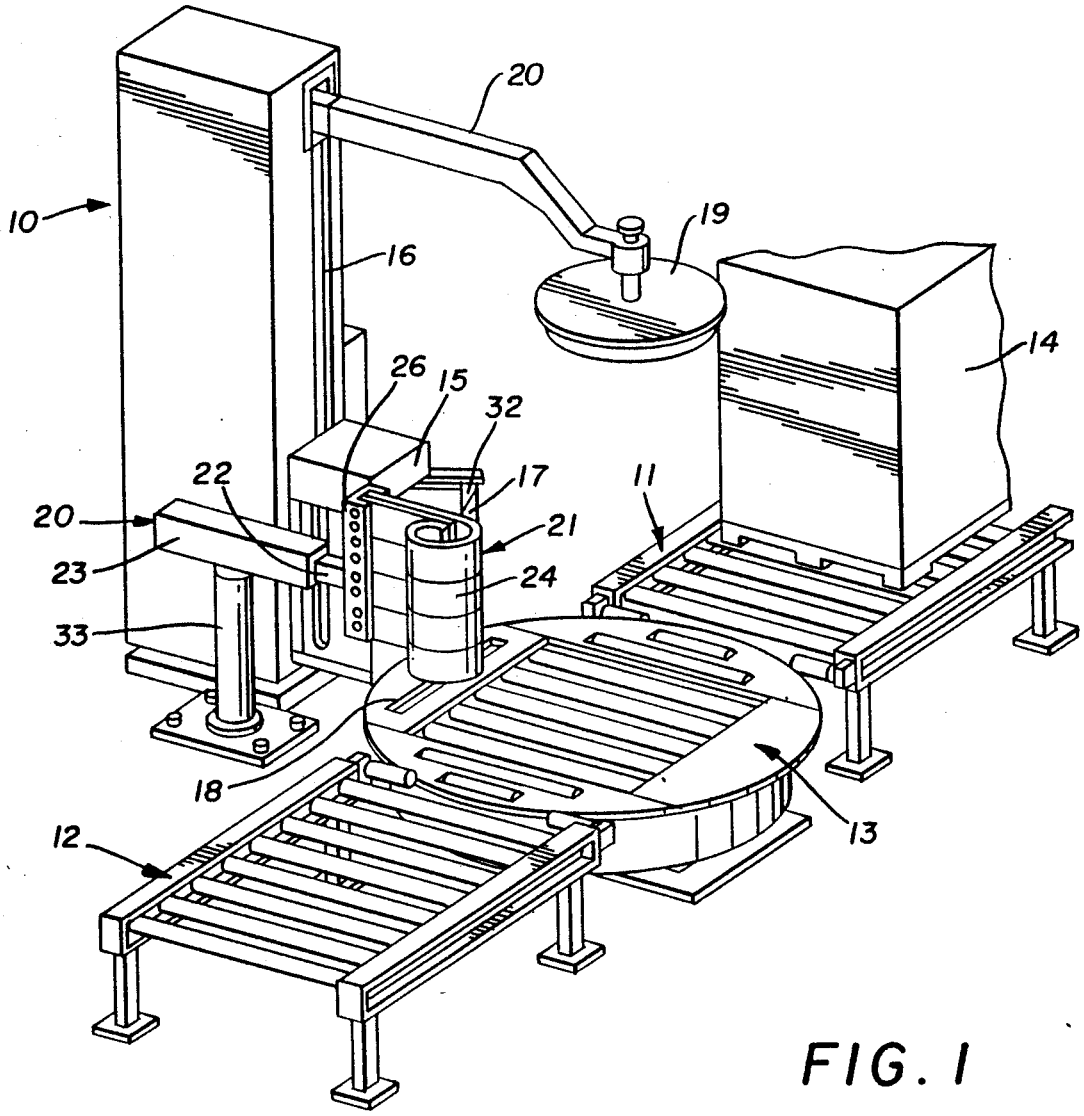
FIG. 1 is a perspective view of the wipe down apparatus for a stretch wrapping machine.
Figure 2:
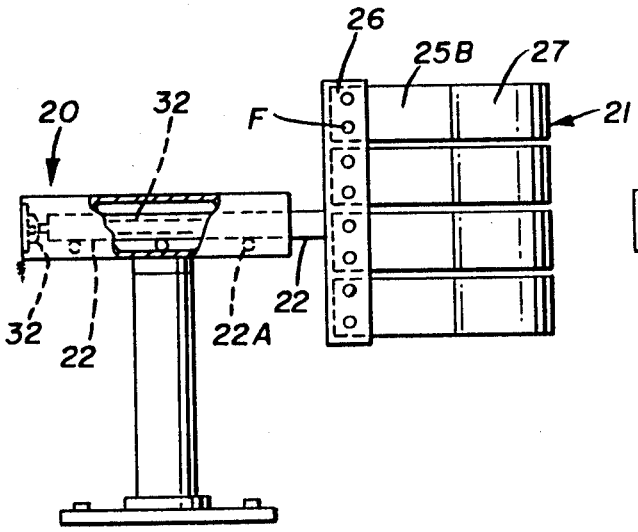
FIG. 2 is a side plan view of the wipe down apparatus.

A stretch wrapping device 10 can be seen in FIG. 1 of the drawings having an inlet conveyor 11 and an outlet conveyor 12. A turntable conveyor 13 is positioned therebetween on which a palletized load 14 can be positioned for wrapping. The stretch wrapping device 10 comprises a film dispensing and elongation head 15 movably positioned on a support and drive column 16. A film web 17 of elongated film extends from said elongation head 15 and is initially held in position on the turntable conveyor 13 by a clamping means 18.

A load stabilization platen 19 is movably positioned on a support arm 20 extending from the support and drive column 16. The platen 19 is engageable onto the top of the palletized load 14 after same has been positioned for wrapping on the turntable conveyor 13 as will be well known and understood within the art.

A wipe down apparatus 20 of the invention can be seen in FIGS. 1 through 4 of the drawings positioned on the interconnected to and controlled by said stretch wrapping device 10 to sequencially engage and wipe down the palletized load 14 after it has been unitized by wrapping same with the film web 17 as the palletized load rotates on the turntable conveyor 13 and the elongation film dispensing head 15 vertically ascends and descends on the support and drive column 16. The wiper apparatus 20 comprises a vertically aligned wiper element 21 secured to an extensible horizontally disposed engagement arm 22 within a rectangular deployment and drive housing 23. The wiper element 21 is comprised of at least one flexible strip assembly 24 having a pair of unequal length strips 25A and 25B abutting along their adjoining surfaces and secured to one another at their respective free ends within a support bracket 26 by a fastener F respectively. The wiper strip 25A defines a loop configuration at 27 as it doubles back on itself to the fastener F as hereinbefore described. The flexible strip assembly 24 deflects as it engages the palletized load 14 bowing and separating the strips 25A and 25B which imparts a flexible focal point at 28 defining a longitudinal line of variable thrusts towards the palletized load 14 and its engaging loop configuration at 27 seen in FIG. 4 of the drawings.

Figure 3:
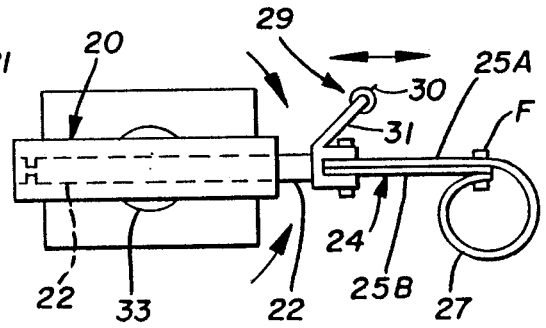
FIG. 3 is a top plan view of the wipe down apparatus.

Referring now to FIG. 3 of the drawings a film web cutting assembly 29 is positioned in spaced relation to said wiper element 21 comprising a hot wire 30 mounted on a support bar 31 which is typical of such structures found in prior art.

The engagement arm 22 is movably positioned on guides 22A by a pneumatic cylinder assembly 32 within for horizontal extensible action from said housing 23 which is pivotally secured to a support column 33 allowing for arcuate travel on a horizontal plane indicated by arrow in FIG. 3 of the drawings.

Figure 5:
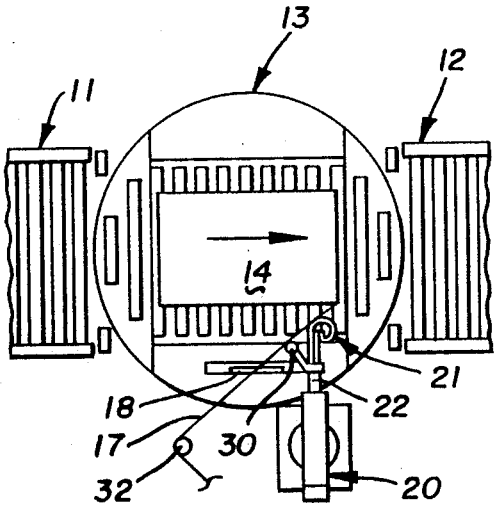
FIG. 5 is a schematic top plan view of the wipe down apparatus shown in FIG. 1 engaging a load.
Figure 6:
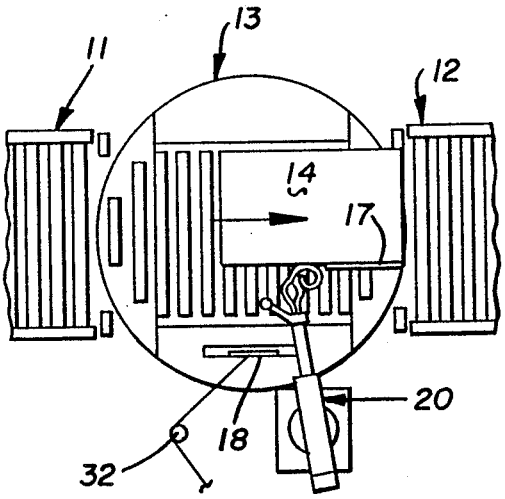
FIG. 6 is a schematic top plan view of the wipe down device shown in FIG. 1 at the end of the wipe down sequence.

By referring to FIGS. 5 and 6 of the drawings, a cut and wipe down sequence is illustrated with the termination of rotation of the load on the turntable conveyor 13 and the clamping of the film web by the clamping means 18 wherein the hereinbefore described film cutting assembly 29 is advanced to engage the film web 17 within the plane of the film path from the load to the film elongation and dispensing head 15 having a spaced guide roller 32. The cutting action via the hot wire 31 occurs simultaneously with the relative advancement of the wiper element 21 to the palletized load 14 thereby severing the film web 17 and wiping down the load in a single motion as seen in FIG. 6 as the palletized load moves off the turntable conveyor 13 illustrated by the directional arrow thereon.

It will be noted that for purposes of illustration palletized load 14 is positioned closer to the wipe down device in FIG. 5 than it is shown in FIG. 6. It will be evident that loads positioned variably on the conveyor turntable 13 can be engaged by the wipe down device regardless of their initial positioning on the conveyor turntable 13.

Since the palletized load 14's movements off the turntable conveyor 13 is used to complete the wipe down as the wiper elements engage the load the relative movement of the support arm 20 and the wiping element is limited after the film web 17 is cut as hereinbefore described. After the wipe down is complete the arm 22 is retracted and the support arm assembly 20 is returned to its position prior to activation and is thus reset for the next wipe down sequence.

Figure 7:
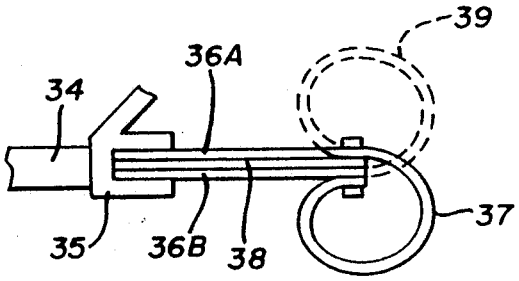
FIG. 7 is an enlarged top plan view of a portion of an alternate form of the wipe down apparatus.
Figure 4:
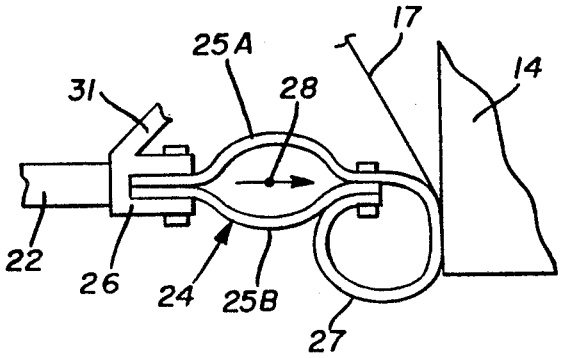
FIG. 4 is an enlarged top plan view of a portion of the wipe down apparatus engaging a load.

Referring now to FIG. 7 of the drawings an alternate form of the invention can be seen having an engagement arm 34 with a support bracket 35 and at least one flexible strip assembly having a pair of unequal length strips 36A and 36B with a stiffening element 38 positioned therebetween. The strips 36A and 36B abut the stiffening element 38 along respective parallel surfaces and are secured to one another and the stiffening element 38 at their respective free ends. The strip 36A defines a loop configuration 37 as it doubles back on itself to a fastener F securing the unequal length free ends of said strips to the stiffening element 38.

An alternate loop position is shown in FIG. 7 defined by a repositioned loop 39 in broken lines extending from the opposite side of said loop 37 providing an optional mounting position that may be more efficient for some load configurations.

Among the advantages of the present invention is the adaptability of the device to a variety of load positioning on the turntable conveyor 13. The extension of the arm 22 can be programmed to meet the positioning requirement of any load on the turntable conveyor 13 and can be preset to any number of predetermined positions which could be selected by sensors 34 on the conveyor turntable 13 activated by the position of the palletized load 14 thereon.

It will thus be seen that a new and novel wipe down device has been illustrated and described and it will be apparent to those skilled in the art that various changes and modifications may be made therein without departing from the spirit of the invention.

Therefore I claim:

1. A wipe down apparatus for use with stretch wrapping device for wrapping a load with a film web, the wipe down apparatus comprises a wiper support, an engagement arm telescopically extensible from said support, a wiper element secured to said free end of said engagement arm, said wiper element comprising at least one wiper including a pair of unequal length strips, one of said strips double back on a portion of itself forming a loop in spaced relation to the engagement arm, means for securing the unequal free ends of said strip to each other and to one of said strips inwardly from its secured free end, means for securing the abutting ends of said strips to said engagement arm, means for moving said engagement arm and said wiper support in relation to said load and means for cutting said film web within a film plane path.

2. The wipe down apparatus of claim 1 wherein said means for securing the unequal length free ends of said strips comprises a fastener.

3. The wipe down apparatus of claim 1 wherein said means for securing the abutting ends of said strips comprises an elongated support bracket.

4. The wipe down apparatus of claim 1 wherein said means for moving said engagement arm and wiper support comprises pneumatic cylinders controlled by said stretch wrapping device.

5. The wipe down apparatus of claim 1 wherein means for cutting said film web within the film web's path comprises a hot wire assembly positioned on said extensible arm in angular relation to said wiper element.

6. The wipe down apparatus of claim 1 wherein one of said unequal length strips is resiliently stiffer than the other of said strips.

7. A wipe down apparatus for use with a stretch wrapping device for wrapping a load with a film web, the wipe down apparatus comprises a wiper support, an engagement arm telescopically extensible from said support, a wiper element secured to said free end of said engagement arm, said wiper element comprises at least one wiper including a pair of unequal length strips, one of said strips double back on a portion of itself forming a loop in spaced relation to the engagement arm, a stiffening element between said strips, means for securing the unequal free end of said strips to each other and to one of said strips inwardly from its secured end, means for securing the abutting ends of said strips and said stiffening element to said engagement arm, means for moving said engagement arm and said wiper support in relation to said load and means for cutting said film web within a film plane path.

* * * * *